US006095918A

United States Patent [19]

Arroyo et al.

[11] Patent Number: 6,095,918

[45] Date of Patent: Aug. 1, 2000

[54] METHOD AND DEVICE FOR PROTECTING A WORK SURFACE

[75] Inventors: Georges Arroyo, La Mézière; Philippe Marchal, Plélan-le-Grand, both of France

[73] Assignee: N.I.R. Ultra Propre-Nutrition Industrie Recherche, Paris, France

[21] Appl. No.: 09/202,580

[22] PCT Filed: Jun. 20, 1997

[86] PCT No.: PCT/FR97/01106

§ 371 Date: Mar. 2, 1999

§ 102(e) Date: Mar. 2, 1999

[87] PCT Pub. No.: WO97/49955

PCT Pub. Date: Dec. 31, 1997

[30] Foreign Application Priority Data

Jun. 21, 1996 [FR] France ..... 96 07961

[51] Int. Cl.[7] ..... F24F 9/00

[52] U.S. Cl. ..... 454/188; 454/49; 454/191

[58] Field of Search ..... 454/49, 188–191

[56] References Cited

U.S. PATENT DOCUMENTS

| | | | |
|---|---|---|---|
| 2,119,282 | 5/1938 | Ludwig | 454/191 |
| 4,915,622 | 4/1990 | Witmer | 454/188 |

FOREIGN PATENT DOCUMENTS

| | | | |
|---|---|---|---|
| 0375343 | 6/1990 | European Pat. Off. . | |
| 0510637 | 10/1992 | European Pat. Off. . | |
| 6-213488 | 8/1994 | Japan | 454/188 |
| 6-221639 | 8/1994 | Japan | 454/188 |
| 9105210 | 4/1991 | WIPO . | |

*Primary Examiner*—James C. Yeung
*Attorney, Agent, or Firm*—Ladas & Parry

[57] ABSTRACT

A method and apparatus for closely protecting a workstation. The method includes the steps of (a) providing a horizontal work surface having a top face, an upstream side and a free side opposite the upstream side, the free side having an edge, the work surface being unobstructed and accessible from above the top face and from at least the free side; (b) continuously blowing clean air over the work surface from the upstream side toward the free side so as to form a substantially horizontal flow of the clean air across the work surface and so that the flow of air has a velocity gradient with an upper layer or stream of air having a substantially higher velocity of flow than a lower layer or stream of the air flowing proximal to the top face; and (c) continuously sucking air from the flow of air into a suction intake disposed near the edge of the free side. The apparatus includes (a) an air blower for blowing clean air continuously over the work surface from the upstream side to the free side so as to form a substantially horizontal flow of the clean air across the work surface and so that the flow of air has a velocity gradient with an upper layer or stream of the air having a substantially higher velocity of flow than a lower layer or stream of the air flowing proximal to the top face; and (b) a suction intake disposed near the edge of the free side for collecting air from the flow of air blown to the free side.

17 Claims, 8 Drawing Sheets

υ
(m/s)
V0
V1
0.8
0.6
X(m)
0
0.1
0.17
0.2
0.25
0.3

D
90
13
D1

D
91
B
13
D2

METHOD AND DEVICE FOR PROTECTING A WORK SURFACE

FIELD OF INVENTION

The present invention relates to closely protecting a horizontal work surface by means of a flow of clean air.

The invention relates both to a method and to apparatus for achieving such protection.

The invention relates more precisely to protecting a work surface which is unobstructed, and therefore accessible, both from above and from at least one side of the work surface, which side is referred to as the "free side".

BACKGROUND OF INVENTION

The problem of protecting workstations against contamination from the ambient air is encountered in various branches of industry, in particular in the food industry, in the food-preparing industry and trade (e.g. butchers and caterers, for example), in the pharmaceutical, chemical, microbiology, and aircraft industries, in hospital and surgical fields, in laboratories, and in military applications, or even domestic applications.

The invention applies to all fields in which the quality of the substance(s) processed or treated at a workstation must be preserved or maintained, whatever the pollution in the surrounding atmosphere.

In general, in order to protect a work surface, the work surface is installed inside a sterile "clean" room in which the air is filtered and treated so that it has a given level of cleanness.

The main drawback with that solution is that it is difficult to maintain air quality in a large volume under conditions that are economically acceptable. Another drawback is related to the fact that personnel must wear special clothing, which is itself sterile, which is difficult to maintain impeccably clean, and whose cleanness is difficult to monitor. Wearing such clothing is therefore tiresome. In addition, in spite of such special clothing, personnel and equipment present in the work room can pollute the air.

The close protection technique offers a solution to that problem.

Close protection consists in immersing the work surface and the objects carried thereby in a moving atmosphere of clean air which is continuously renewed.

The work surface is thus protected by a shield of clean air which shields the objects from external contamination, although the remainder of the room containing the work surface contains air that might be polluted. The personnel assigned to performing tasks on said objects can therefore be subjected to hygiene constraints that are less strict.

The work surface may be a stationary table top on which there are placed items that are to be processed or operated on either manually or automatically.

The work surface may also be a conveyor, e.g. a moving belt, which brings successive items to be processed to the work station and removes them once the processing operation is terminated.

By way of example, the items may be receptacles which are conveyed one behind the other by the moving belt, and which are filled by a dispensing head disposed in the protected zone, so that the filling substance is free from any contamination.

The relevant state of the art can be illustrated by Documents FR-A-1 257 562 and EP-A-0 375 343.

Document FR-A-1 257 562 concerns apparatus for maintaining an atmosphere that has determined characteristics in a chamber that is open on one side.

That chamber has a floor constituting a horizontal work surface over which a flow of clean air flows.

The chamber is open on one of its sides only, which side is accessible to an operator, and a second flow of clean air flows across the open side in the form of an approximately vertical curtain directed downwards from top to bottom.

The air is sucked in at the front edge of the work surface (the open side of the chamber), and it is recycled via atmosphere regeneration apparatus so that it flows around a closed-circuit path.

The horizontal flow of air that passes through the inside of the chamber has a speed distribution that is approximately constant over the entire height of the chamber. The value of the speed is independent of the height of the point in question relative to the work surface.

A major drawback with the apparatus described in FR-A-1 257 562 results from the fact the chamber is delimited on top by a ceiling, thereby considerably limiting the accessibility of the work surface.

That raises difficulties in particular when the processing operation to be performed on the items supported by or conveyed by said work surface requires machines or other equipment to be implemented above the work surface.

That is the case, for example, for dispensing and/or metering machines serving to fill receptacles conveyed by a moving belt for the purpose of filling them in the close protection zone.

The apparatus described in Document EP-A-0 375 343 includes a horizontal work surface which is unobstructed both from above and from one of its sides.

A fan disposed under the work surface, and having a filter disposed at its outlet, generates air under pressure in a box opening into a dispensing chamber situated on the non-open side of the work surface.

This chamber produces two flows, namely a horizontal flow passing over the work surface, and a multi-directional flow made up of a plurality of small jets produced by holes formed in the various partitions of the chamber.

The inside of the chamber is provided with cylindrically arcuate guides deflecting the air coming from the box so as to produce the above-mentioned horizontal flow.

Although that known apparatus offers the advantage of being accessible both from one of the sides of the work surface and from above, it nevertheless suffers from the drawback that the speed distribution in the horizontal flow over the work surface is constant.

Unfortunately, distribution of that type does not fully protect the items placed on the work surface. Tests performed by the Applicants have shown that it is desirable to provide a speed gradient, with speeds increasing with increasing distance from the work surface. Particularly effective protection is obtained when the clean air moves at a low speed, or is even almost stationary, in the vicinity of the work surface, while the upper layer of the flow has a relatively high speed.

SUMMARY OF THE INVENTION

An object of the present invention is to mitigate those drawbacks by providing a close protection method and apparatus that, while making good accessibility to the work surface possible, also fully protect the items placed on the work surface.

The invention provides a method of closely protecting a horizontal work surface by means of a flow of clean air, the work surface being unobstructed and accessible both from above and from at least one side, referred to as the "free side", said method being notable in that:

clean air is blown continuously over the work surface from the "upstream" side, which is the side opposite from said free side, in the form of a substantially horizontal flow which sweeps the work surface transversely towards the free side, and which has a speed gradient such that its upper layer—or "high stream" —has a speed significantly higher than the speed of the air flowing in the vicinity of the top face of the work surface; and all or most of the flow is sucked in continuously via the free side by means of a suction intake extending along and in the immediate vicinity of the edge of the work surface.

In addition, according to preferred embodiments of the invention:

the air collected by said suction intake is blown back out via the upstream side after it has been filtered or purified;

the work surface-is a stationary table top; and the work surface is a conveyor

The invention also provides apparatus for closely protecting a horizontal work surface by means of a flow of clean air, the work surface being unobstructed and accessible both from above and from at least one side, referred to as the "free side".

This apparatus is notable in that it comprises:

air blowing means for blowing clean air continuously over the work surface from the "upstream" side, which is the side opposite from said free side, in the form of a substantially horizontal flow which sweeps the work surface transversely towards the free side, and which has a speed gradient such that its upper layer—or "high stream" —has a speed significantly higher than the speed of the air flowing in the vicinity of the top face of the work surface;

a suction intake extending along and in the immediate vicinity of the edge of the work surface; and suction means connected to said intake.

In a preferred embodiment the apparatus is also notable in that:

a single flow generator such as a fan (or a group of juxtaposed fans) blows out the clean air on the upstream side and sucks it in on the free side, at least a portion of the flow being recycled via a closed circuit path;

the air is blown by means of a flow generator, such as a fan, downstream from which at least one filter or some other air purification, is disposed;

the air is blown by means of a flow generator, such as a fan, which is situated below the work surface and which produces a substantially horizontal flow which is deflected through 180° at the upstream side by a tubular guide that is semi-cylindrical or approximately semi-cylindrical in shape;

said air blowing- means comprise a duct that is vertical or approximately vertical disposed on the upstream side, the duct having its low end connected to an air flow generator such as a fan, while its high end opens out substantially level with the work surface, into a tubular guide that is quarter cylinder shaped, or approximately quarter cylinder shaped, and that is suitable for deflecting the flow so as to impart a substantially horizontal direction to it;

the inside of said vertical or approximately vertical duct is provided with at least one deflector forming an acute angle relative to the vertical, and suitable for deflecting a portion of the flow outwards (relative to said work surface) so as to constitute said high stream;

the duct is provided with a plurality of deflectors which are constituted by juxtaposed plane plates disposed in a fanned-out configuration so as to diverge going from the bottom upwards;

the deflector plate that is innermost (relative to said work surface) is substantially vertical;

the inside of said tubular guide is provided with at least one deflector that is cylindrically arcuate and that is coaxial to the guide;

said air blowing means are provided with an overhanging portion forming a visor which overlies the upstream zone of the work surface, and is suitable for directing the high stream slightly downwards;

said suction intake is subdivided into two secondary suction intakes: namely a top intake suitable for collecting the air flow corresponding to the high stream and for allowing it to pass through without headloss, or almost without headloss, and a bottom intake suitable for braking the flow situated under the high stream, e.g. by means of a constriction;

the work surface is a stationary table top; and the work surface is a conveyor.

The term "conveyor" is used herein to designate both a single conveyor and a group of two or more conveyors disposed side-by-side, e.g. a plurality of adjacent belts.

BRIEF DESCRIPTION OF THE DRAWINGS

Other characteristics and advantages of the invention appear from the following description and from the accompanying drawings which show preferred embodiments merely by way of non-limiting example, and in which.

DETAILED DESCRIPTION

Figure 1:
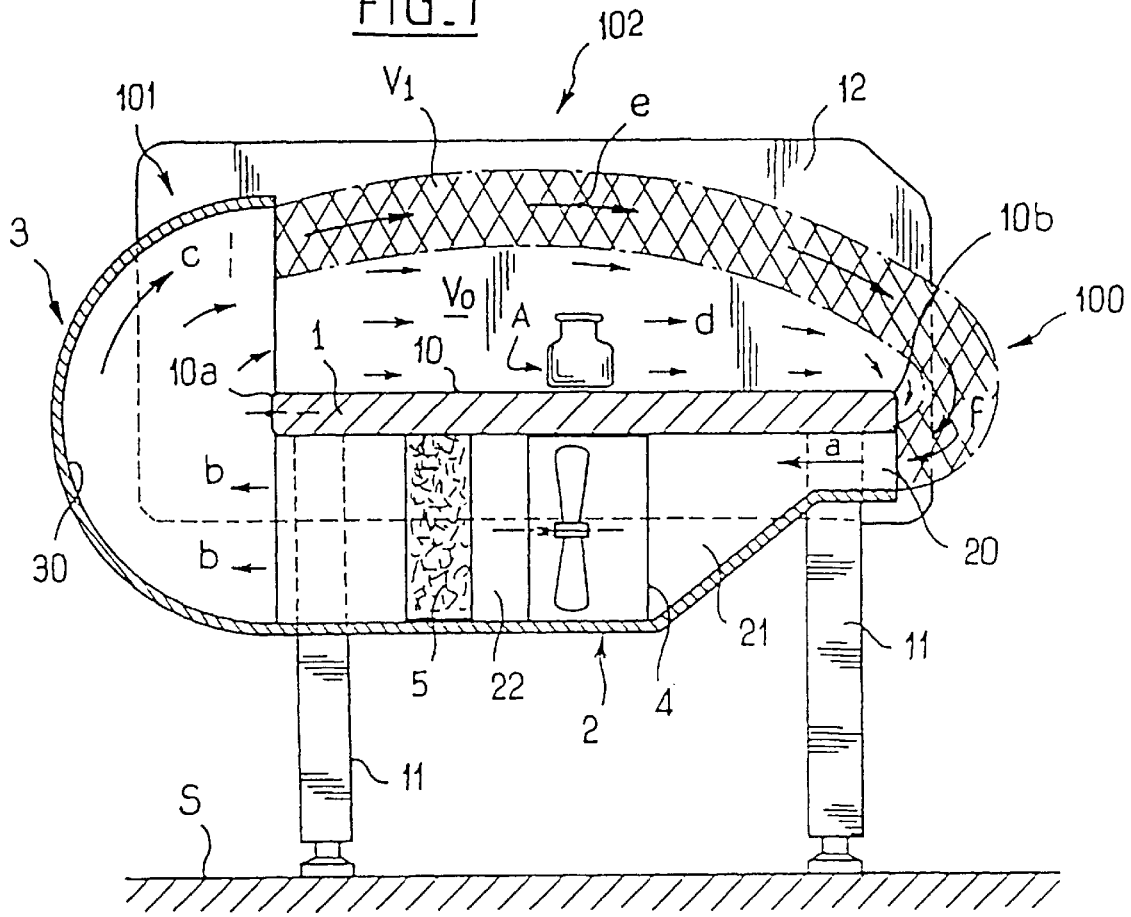
FIG. 1 is a diagrammatic view in section on a transverse vertical plane of a first embodiment of apparatus of the invention, the section plane being referenced I—I in FIG. 2.
Figure 2:
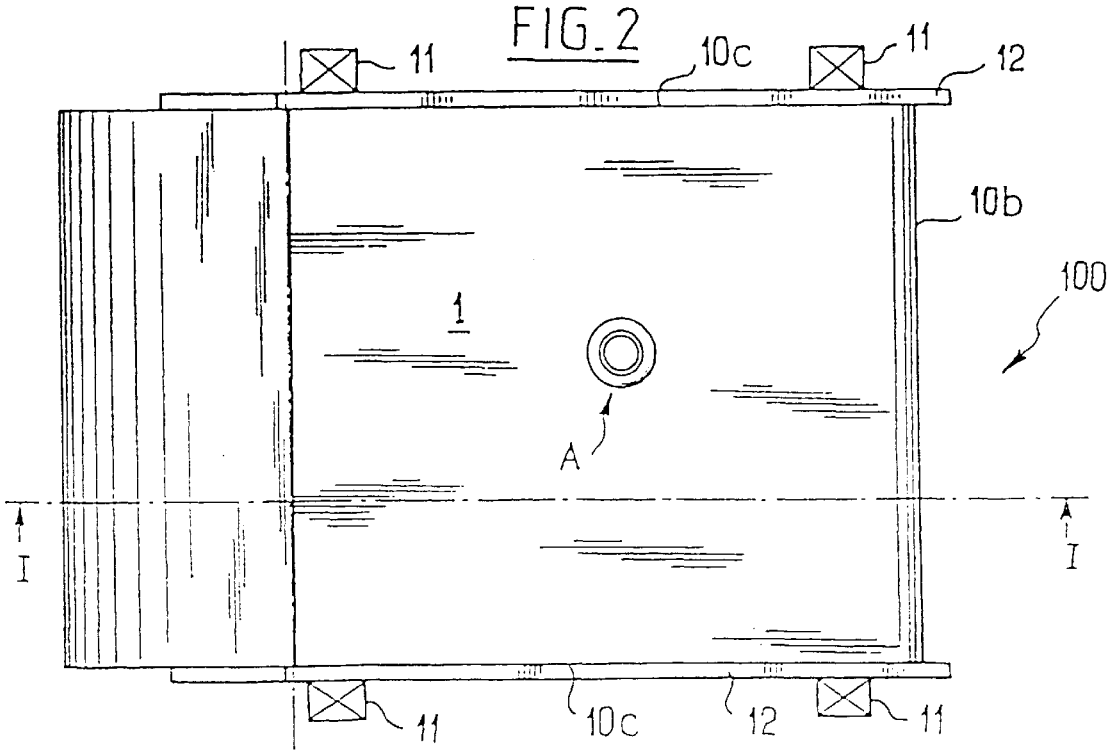
FIG. 2 is a plan view of the apparatus shown in FIG. 1.

In FIGS. 1 and 2, which show a first possible embodiment of the apparatus, reference numeral 1 is used to designate a work surface which, in this example, is a stationary horizontal table top of rectangular shape supported by an underframe 11 that stands on or is fixed to the floor S.

The top face 10 of the work surface is designed to receive items that are to be subjected to some manipulation and/or processing or treatment that must be performed in a clean atmosphere;

An item (in this example a flask) is shown and designated reference as letter A in the figures.

Numerals 10*a* and 10*b* designate the longitudinal edges of the table top 10. They are preferably rounded in profile (with no sharp edges).

Its transverse edges 10*c* bear against a pair of transverse partitions 12 which extend upwards over a certain height relative to the work surface 1.

Under the table top 1, a box 2 is installed.

The box, a tubular duct extending under the entire table top 1, and it provides through transverse communication from one side of the apparatus to the other.

The box 2 is fixed to the table top 1 and/or to the underframe 11 by suitable members (not shown).

A generator system 4 for generating a flow of air is installed inside the box, the system consisting of one or more electric fan(s) suitable for sucking in air at the inlet 20 of the box, at the edge 10*b*, and for blowing it out the other side, at the edge 10*a*.

The air inlet portion 20 of the box is of smaller section than the main portion 22 which receives the generator 4.

The inlet portion 20 constitutes a suction intake situated under the table top 1 in the immediate vicinity of the edge 10*b*. The transition between the narrow-section portion 20 and the main portion 22 is implemented in the form of a flaring portion 21.

On the opposite side, the main portion 22 opens out into a semi-cylindrical guide 3 whose radius corresponds to the height of the portion 22, and whose axis of circular symmetry is situated at the edge 10*a*.

The guide 3, whose inside wall is designated by reference 30, opens out above the table top 1 vertically above the edge 10*a*.

Naturally, the box 2 and the guide 3 are closed along their transverse sides by suitable transverse walls.

Inside the box portion 22 that is downstream from the generator 4, wherein air purification or filtration apparatus 5 is installed, made up, for example, of one or more filter pads.

The filter elements are of known type, and are suitable for retaining impurities or particles present in the air delivered by the generator 4.

The composition and the porosity of the elements are chosen as a function of the application, and in particular of the required degree of cleanness.

Operation of the apparatus is shown in FIG. 1, the arrows representing the path of the air serving to protect the flask A situated on the work surface.

The lengths of the various arrows are chosen to be approximately proportional to the speeds of the flow of air at the places in question.

The apparatus shown in FIGS. 1 and 2 constitutes a workstation for a person (not shown) assigned to performing a certain task on the item A, the person being on the unobstructed side of the apparatus, which side is designated by referenced numeral 100 and corresponds to the edge 10*b*.

By convention, this side 100 is referred to as the "free side".

The other side, designated by referenced numeral 101, on which the guide 3 is situated, is referred to as the "upstream side" by reference to the direction of displacement of the flow of clean air over the work surface.

Finally, the space above the work surface, which space is also unobstructed, is designated referenced by numeral 102.

Since the spaces 100 and 102 are unobstructed and accessible, the operator can, without difficulty, be positioned in the vicinity of the work surface, so as to manipulate the items to be treated thereon, and so as to make use of the various instruments or equipment, e.g. moving filling apparatus, situated in the top space 102.

Once the generator 4 is started, it sucks in a flow of air continuously via the intake 20, as represented by arrow a.

After being filtered, the flow of air exits from the box 2 as represented by arrows b, and it is deflected through 180° inside the semi-cylindrical guide 3.

As a result of inertia, variation in speed is observed in the radial direction.

Once the flow has been turned round, at the outlet of the guide 3, the outer stream, which becomes the "top stream" or "high stream", $V_1$, has a speed that is considerably higher than speed of remainder of the flow.

This stream is shown by cross-hatching in FIG. 1, while the remainder of the flow, or "bottom flow" is referenced $V_0$.

Within the stream $V_0$, a speed gradient can be observed, with the speed being very low or even zero in the vicinity of the face 10 and increasing progressively going upwards to the stream $V_1$.

The radius of the guide 3, which radius determines the height of the flow of air delivered by the guide over the work surface, is preferably chosen as a function of the height of the items in question, so that the items are immersed in the bottom flow $V_0$.

In the embodiment shown in FIGS. 1 and 2, the axis of circular symmetry of the semi-cylindrical guide 3 substantially coincides with the edge 10*a*. Naturally, this configuration is not essential. The position of the axis could be offset upwards or downwards, and the radius modified, to adjust the magnitudes of the speeds $V_0$ and $V_1$.

The high stream $V_1$ acts as a vault-shaped shield which protects the entire space above the surface 10 so as to shield it from pollution in the ambient air situated in the open top space 102 and in the open side space 100.

Any contamination particles that reach the vicinity of the stream $V_1$ are immediately swept away by it and transferred at high speed towards the free side 100.

On the transverse sides, protection is provided by fixed partitions 12.

The flow of air in the bottom stream $V_0$ and the flow of air in the high stream $V_1$ are respectively represented by arrows d and e.

These two flows join at the downstream side beyond the free edge 10*b*, and at least a portion of the overall flow goes down round the edge 10*b*, as represented by arrows f, and penetrates into the intake 20. This downward rounding is facilitated by the rounded shape of the edge 10*b*.

At least most of the air is thus recycled, and, since it is almost clean or most of it is clean, the filter elements are slow to clog up.

This circulation of air takes place continuously, so long as there are items to be protected on the work surface.

By means of the transverse partitions 12, the flow of clean air over the work surface is not disturbed, or is hardly disturbed, in the vicinity of the transverse sides 10*c* of the work surface.

Naturally, it is desirable for the hands of the operator to be protected by sterile gloves, and for any instrument or equipment inserted into the protected space to be fully clean.

However, the nature of the generated flow facilitates immediate removal of any pollutants that might enter undesirably in such a manner.

Figure 3:
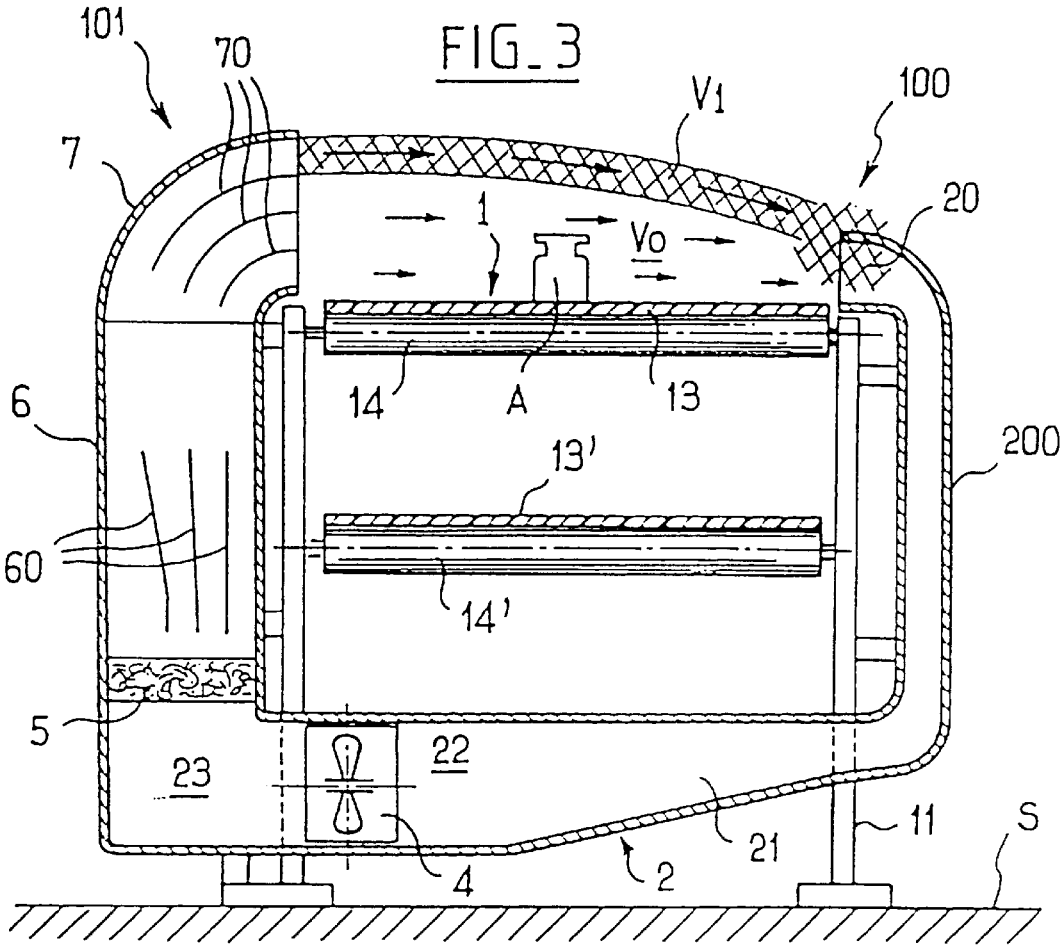
FIG. 3 is a diagrammatic view analogous to the FIG. 1 view, but showing a second embodiment of the apparatus.

In the second embodiment shown in FIG. 3, the elements that are identical or similar to those in the first embodiment are given the same reference numerals.

In this variant, the side walls are omitted, and this variant is thus suitable for a work surface that extends beyond the sides designated by reference numeral 10*c* in the first embodiment, in particular in the form of a conveyor (a moving work surface).

The apparatus shown in FIG. 3 includes a work surface 1 which, instead of being constituted by a stationary table top, is constituted by a conveyor, and more particularly by the top run or "go run" 13 of a moving endless belt.

Usually, the "return run", referenced 13' extends under the go run 13.

The two runs 13 and 13' are supported in well known manner by suitable guide means such as rotary bearing rollers 14, 14'.

Suitable drive means make it possible to displace the belt either continuously or stepwise.

The top run 13 conveys objects, e.g. flasks A.

At some stage of their journey, these objects are to be subjected to some processing or treatment, e.g. to filling, in a space that must be protected from contamination from the ambient air.

The apparatus of the invention is thus installed on the path of the conveyor so as to protect a portion thereof.

As can easily be understood merely by observing FIG. 3, the presence of two runs 14 and 14' one above the other occupies a relatively large space under the work surface 1, thereby preventing the air-flow generator from being installed immediately under the work surface.

A configuration identical to the configuration of the first embodiment (FIGS. 1 and 2) can thus not be transposed to cope with these conditions.

In this second embodiment, the suction intake 20 at the inlet of the box 2 has its opening directed horizontally, facing the space situated immediately above the work surface 1.

This suction intake 20 is curved downwards over a quarter cylinder, so as to connect to a vertical tubular portion or "tube" 200 extending along the free edge 100.

The tube 200 is itself connected to box portions 21 and 22 which are similar to those of the first embodiment, and which are installed below the return belt run 13', and below the bearing rollers 14' thereof, in the vicinity of the floor S.

It is in this portion 22 that the generator 4 is mounted, which generator is made up of one or more fans.

Via a right-angled bend 23, the box 22 itself opens out into a vertical tube or "chimney" 6 disposed on the upstream side 101.

Finally, the top of the tube 6 is connected to a guide 7 that is quarter cylinder shaped, which guide opens out in the vicinity of the work surface 1 on the upstream side.

One or more filters 5 are mounted at the outlet(s) of the fan(s) 4, e.g. at the base of the chimney 6.

Unlike the above-described first embodiment, the guide 7, which channels the flow of clean air as it arrives over the work-surface, deflects the air through one fourth of the circumference (90°) only.

Tests performed by the Applicants have shown that this angle is not sufficient on its own to ensure that the speeds are distributed suitably within the flow of clean air generated over the work surface.

The speed gradient is such that there is not a large difference between the speeds measured in the high stream $V_1$ and in the remainder of the flow $V_0$.

Therefore, in this embodiment, in order to obtain a clear increase in the speeds distributed in the high portion of the flow, a series of deflectors 60 are provided inside the vertical chimney 6.

The deflectors are constituted by plane blades whose large faces are parallel to the longitudinal edges of the work surface 1, i.e. to the sides of the belt 13.

Figure 5:
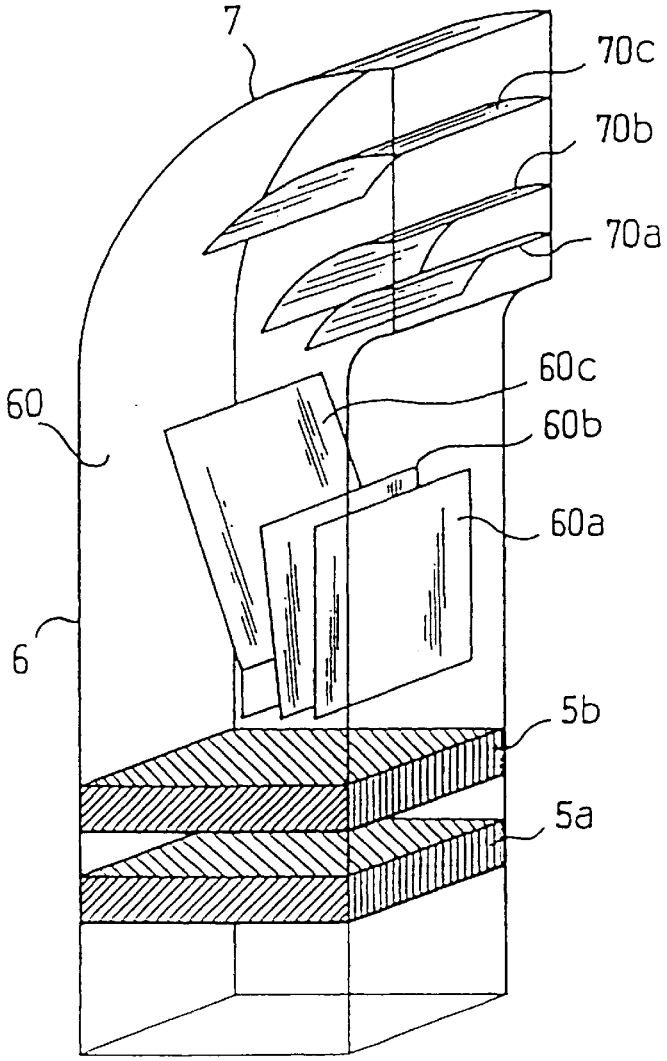
FIGS. 5 and 6 are diagrams, respectively in perspective and in section on a transverse vertical plane, showing a portion of the air blowing and deflecting system suitable for equipping the apparatus.
Figure 6:
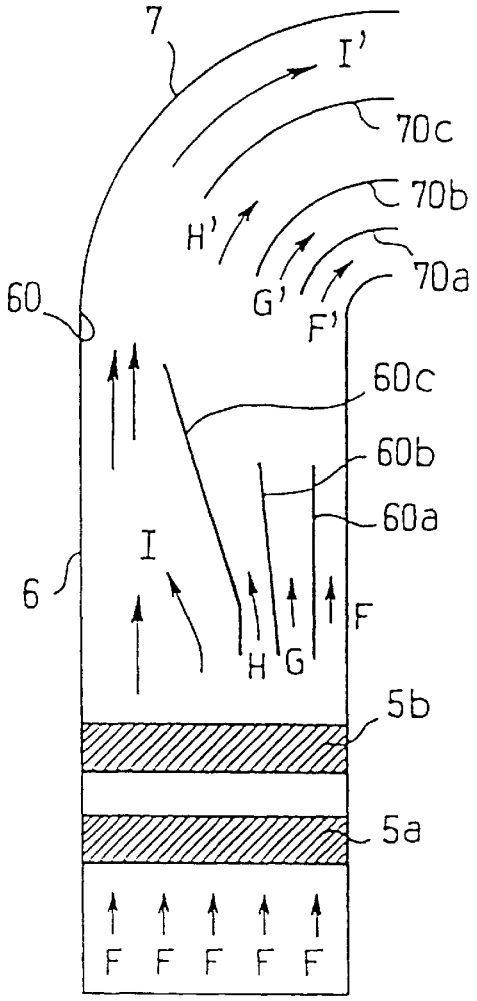

In the embodiment shown in FIGS. 3, 5, and 6, a series of three deflectors 60 are provided. The innermost deflector, i.e. the deflector facing the work surface and designated by reference by reference numeral 60*a* in FIGS. 5 and 6, is a vertical plane plate.

The outermost plate, designated by reference numeral 60*c* in FIGS. 5 and 6, includes a vertical bottom zone, of limited height, its main portion making an acute angle relative to the vertical so that it is directed upwards and outwards.

The intermediate deflector 60*b* is a plate that also slopes relative to the vertical, in the same direction as the deflector 60*c* but at a smaller angle.

Seen from the side (FIG. 6), the series of deflectors 60 thus has the overall appearance of fanned-out slats that diverge going upwards, i.e. going downstream relative to the displacement of the air in the chimney 6.

Observing FIGS. 5 and 6 makes it possible to understand clearly the purpose of these deflectors.

Arrows F designate the flow rate of air at the base of the chimney 6.

After passing through a filter which, in this example is made up of two superposed filter elements 5*a* and 5*b*, a large portion of the air is intercepted and directed outwards by the deflector 60*c*, as represented by arrows I.

The innermost air stream, to the right of the inner deflector 60*a* in FIG. 6 is not deflected at all, and the path it follows is vertical only.

In the zones between the deflectors 60*a* and 60*b*, and between the deflectors 60*b* and 60*c*, the flow of air is deflected outwards to an increasing extent, as represented by arrows G and H.

On entering the quarter cylinder shaped guide 7, i.e. at the base thereof, the air flow-rate increases progressively from the inside to the outside of the quarter cylinder.

As shown in the figures, the inside of the guide 7 is also provided with a set of three deflectors 70.

In FIGS. 5 and 6, the inner deflector is designated by reference numeral 70*a*, the intermediate deflector is referenced 70*b*, and the outer deflector is designated by reference 70*c*.

These deflectors are curved plates in the form of circular arcs coaxial with the guide 7.

The deflector 70*a* is positioned so as to channel the innermost vertical flow F, so as to impart a horizontal direction to it (arrow F').

Most of the air stream coming from the space situated between the deflectors 60*a* and 60*b* is channeled between the deflectors 70*a* and 70*b* (arrow G'), while most of the air stream coming from between the deflectors 60*b* and 60*c* is channelled between the deflectors 70*b* and 70*c* (arrows H').

Finally, after having been channeled by the deflector 60*c*, the highest-speed air stream I which flows in the vicinity of the wall 60 of the chimney 6 is guided in the channel formed by the wall of the guide 7 and the outermost deflector 70*c*.

It is in this space that the air stream is of highest speed, represented by arrow I'. It is this air stream that constitutes the high stream $V_1$, represented by cross-hatching in FIG. 3.

The presence of the curved deflectors inside the guide 7 is essential when, as is the case in the second embodiment, the apparatus is not provided with transverse partitions delimiting the protected space in the longitudinal direction, as the partitions 12 do in the first embodiment.

By imparting a substantially horizontal direction to the air flow, these deflectors prevent a low-pressure zone from forming at the entrance to and in the vicinity of the work surface. Such a low-pressure zone would suck in ambient air via the open transverse sides of the work surface.

Such partitions cannot be provided when the work surface consists of a conveyor, because such partitions would prevent the conveyed items from passing.

Naturally, similar arcuate deflectors may also be provided inside the semi-cylindrical guide 3 of the apparatus shown in FIGS. 1 and 2, regardless of whether or not the apparatus is provided with transverse partitions 12.

The second embodiment of the apparatus, shown in FIG. 3, operates in a manner entirely similar to that in which the first embodiment of the apparatus operates, most of the air being recycled after sweeping the work surface, by being sucked in via the intake 20, passing through the fan 4 and through the filter 5, and being deflected and channelled in the chimney 6 and in the guide 7.

Figure 4:
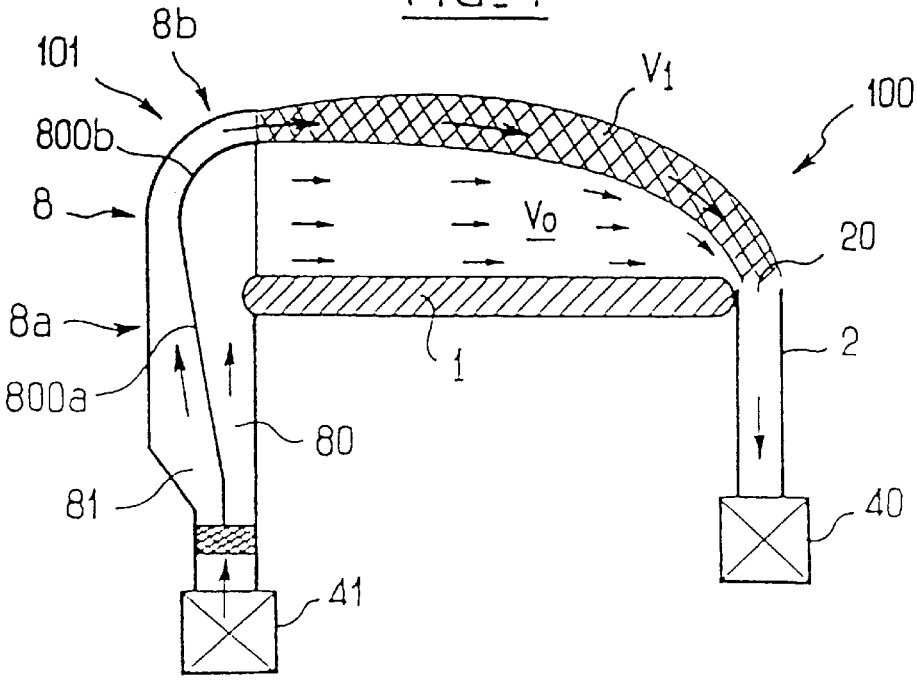
FIG. 4 is a diagram showing a third embodiment, also in section on a transverse vertical plane.

In the variant shown in FIG. 4, the air is not recycled.

The generator, e.g. a fan 41, sucks in ambient air so as to propel it, after it has been filtered or purified, via a box 8 above the work surface 1.

On the other side, the suction intake 20 is connected via a duct 2 to suction means 40 distinct from the fan 41.

In the embodiment shown, the box 8 is disposed on the upstream side of the work surface 1 which may either be a stationary table top or a conveyor.

The fan 41 is situated at the base of the box.

At its bottom, the box has a flared portion 81 which opens out upwards into a duct 8*a* that is substantially vertical and that is extended by a guide 8*b* that is approximately quarter cylinder shaped.

Correct distribution of the speeds over the work surface is achieved by means of an inner deflector made up of a plane portion 800*a* slanting upwards and outwards and extended in the guide 8*b* by a cylindrically arcuate portion 800*b*, coaxial to the wall of the guide 8*b*.

As in the preceding embodiments, the flow of air is made up of a high-speed high stream $V_1$ which protects a bottom stream of low speeds $V_0$. Naturally, the dimensions of the apparatus of the invention are matched to the application in question, and in particular to the dimensions of the items to be processed.

Merely by way of indication, the following examples of values for the dimensions may be given:

width of work surface (i.e. distance between the edges 10*a* and 10*b*): in the range 0.3 meters to 2 meters;

length of protected zone (i.e. distance in the longitudinal direction): in the range 0.3 meters to 3 meters; and height of clean air flow at the outlet of the guide 3, 7, or 8*b*: in the range 0.25 meters to 0.7 meters.

Naturally, the air flow rate generated by the fan(s) depends directly on these dimensions, as does the speed at which the flow circulates.

Figure 7:
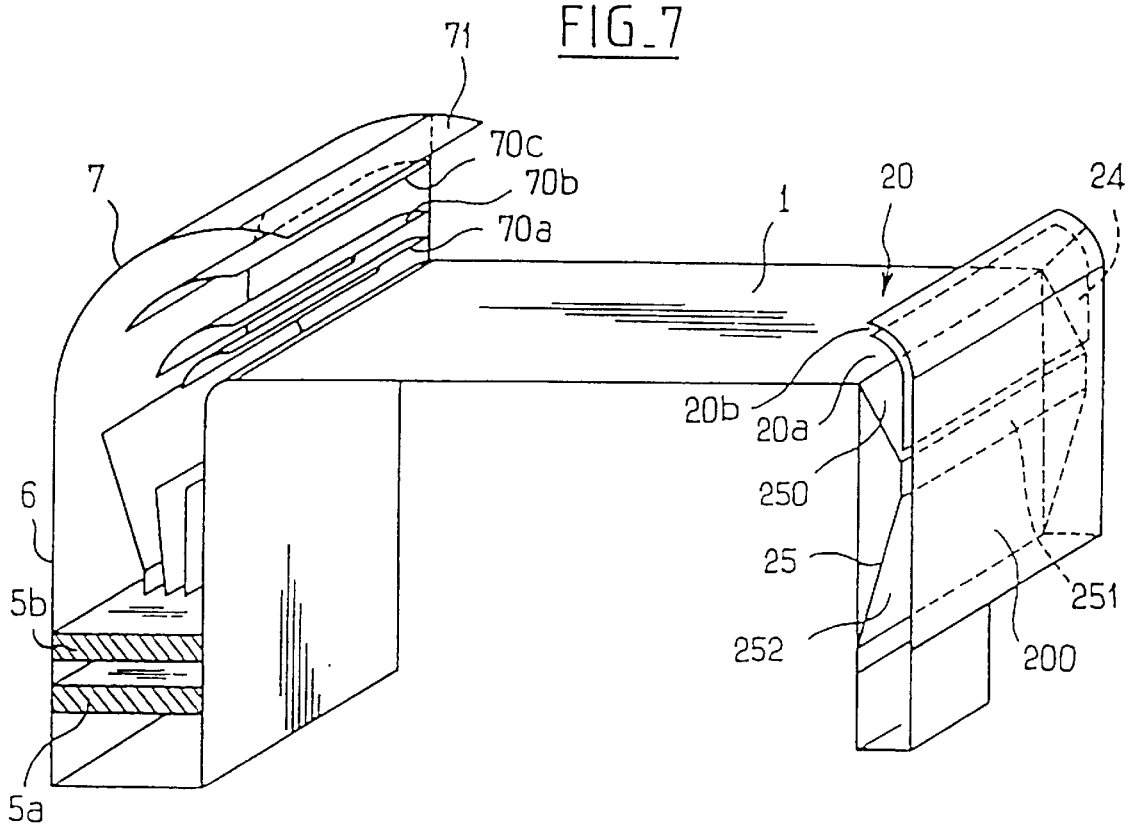
FIGS. 7 and 8 are diagrams, respectively in perspective and in cross-section, showing a fourth possible embodiment of the apparatus.
Figure 8:
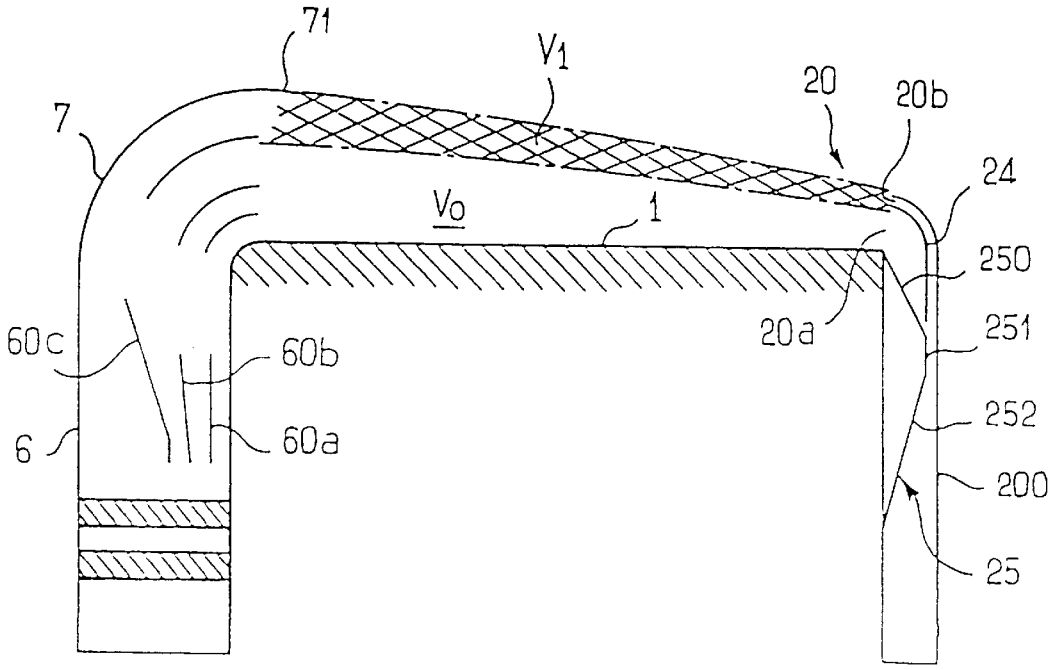

The fourth embodiment, shown in FIGS. 7 and 8, includes an air blowing system 6, 7 analogous to the system shown in FIGS. 5 and 6, and the same reference numerals are used to designate identical or similar elements.

However, it should be noted that the guide 7 that channels the air above the work surface 1 is extended at its outlet by an overhang or visor portion 71 which overlies the upstream edge zone of the work surface 1, and slopes downwards slightly relative to the horizontal.

The function of this visor 71 is to direct the high stream $V_1$ downwards slightly towards the top of the suction intake 20, and to reduce air leaks above said intake.

A partition 24 and a flow-braking element 25 are mounted inside the suction tube 200.

The partition 24 is disposed in the top portion of the tube 200 in the vicinity of its outer wall. The shape of the partition 24 is similar to the shape of that portion of the outer wall facing which it is situated, these two elements forming a channel whose top forms a quarter circle and whose bottom is rectilinear and vertical.

The element 25 is fixed against the inner wall of the tube 200. Going from top to bottom, the element 25 comprises a top face 250 forming a convergent dihedron with the bottom portion of the partition 24, a vertical face 251 substantially in alignment with said bottom portion of the partition, and a divergent face 252.

The elements 24 and 25 subdivide the suction intake 20 into two secondary intakes, namely an outer and top intake 20*b* of constant section and an inner and bottom intake 20*a* of section tapering to a constriction situated at the outlet zone of the intake 20*b*.

This configuration offers the advantage of creating, in the suction tube 200, a vertical speed distribution that corresponds to the vertical speed distribution created on the blowing side. The air is sucked into the intake 20 at a higher speed in its high portion.

The high-speed stream $V_1$ is stabilized and its tendency to rise under the effect of external disturbances (air currents), or to turn down towards the work surface is reduced. The top secondary intake 20*b* in which the flow of air is direct (without headloss) collects almost all of the high stream $V_1$. The braked flow in the intake 20*a* forms a cushion of air which prevents the high stream $V_1$ from turning downwards.

This embodiment is particularly recommended when there are no transverse partitions (reference numeral 12 in FIGS. 1 and 2) flanking the sides (reference numerals 10*c*) of the work surface.

It makes it possible to reduce significantly any penetration of external air that might take place at said sides. Tests performed by counting particles have shown that polluted air can penetrate via a side 10*c* but that it is rapidly channeled towards the suction intake 20. It can therefore contaminate the clean zone over a shallow depth only.

The presence of the visor 71 and of the elements 24 and 25 causes this depth to be limited and stabilized.

These provisions are naturally equally applicable regardless of whether the work surface 1 is in the form of a stationary table top or is in the form of a conveyor, and regardless of whether the air flow is produced in a closed circuit (FIGS. 1 and 3) or in an open circuit (FIG. 4).

Figure 9:
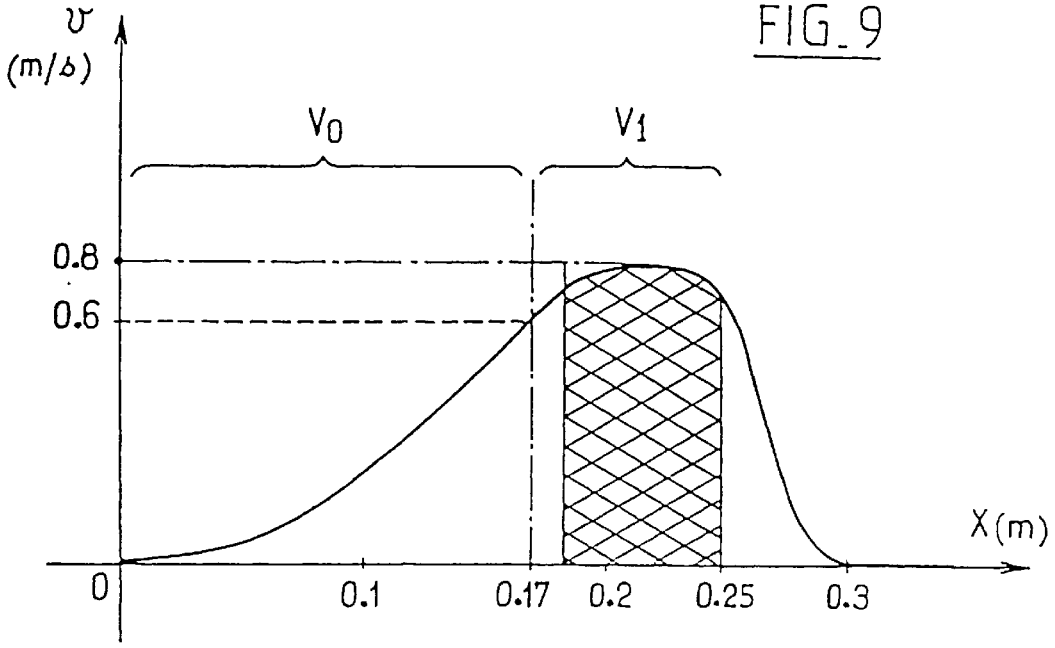
FIG. 9 shows a curve showing one way in which speed within the flow of clean air over the work surface can vary as a function of the distance of the measurement point from said work surface.

Merely by way of example, FIG. 9 shows a possible distribution of the speeds over the work surface in the central zone thereof, within a flow of clean air having a height of 0.30 meters. The external air is assumed to be stationary.

For the curve shown in FIG. 9, distance (height) X in meters(m) between the measurement point and the top face of the work surface is plotted along the x-axis.

Speed v in meters per second (m/s) is plotted up on the y-axis.

It can be observed that, between the height 0 m and the height approximately 0.17 m, the speed increases progressively to a value of about 0.6 m/s.

This area corresponds to the low-speed stream $V_0$.

The air speed then increases less steeply and levels off at an approximately constant value in the vicinity of 0.8 m/s in the height zone lying in the range 0.18 m to 0.25 m.

This area corresponds approximately to the stream $V_1$.

The speed then falls off steeply so that it is close to zero at a height of 0.30 m, where the polluted ambient air lies.

Figure 10:
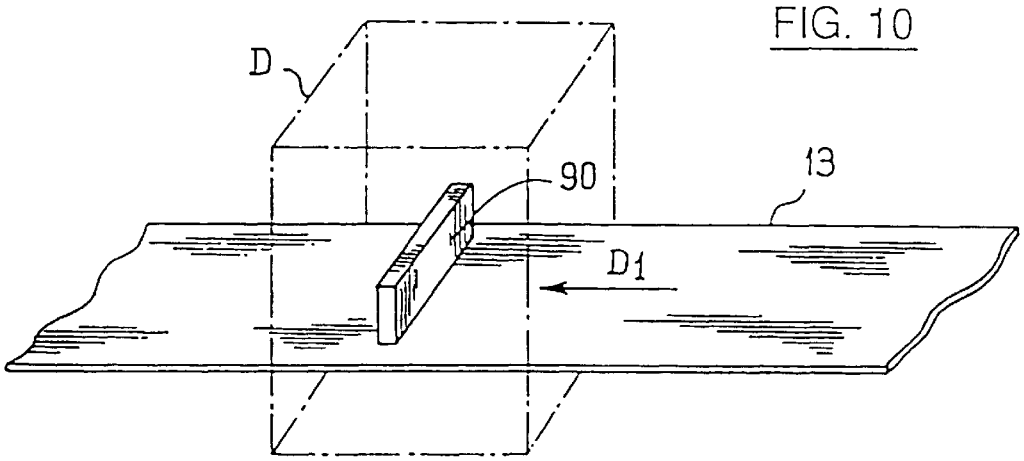
FIGS. 10 and 11 are perspective diagrams showing two conveyors suitable for being associated with apparatus of the invention.

The diagram in FIG. 10 shows an installation for depositing coating substances on a base which is displaced continuously by means of a conveyor belt 13.

The advance of the conveyor is designated by reference letter $D_1$, while the tool depositing the coating is designated by reference numeral 90.

By way of indication, the conveyor 13 is of width 1.5 m, and it advances at a speed lying in the range 5 meters per minute (m/min) to 10 m/min.

The conveyor passes inside the zone protected by means of the apparatus of the invention, the outline of the apparatus being represented by dashed lines and being designated D.

Figure 11:
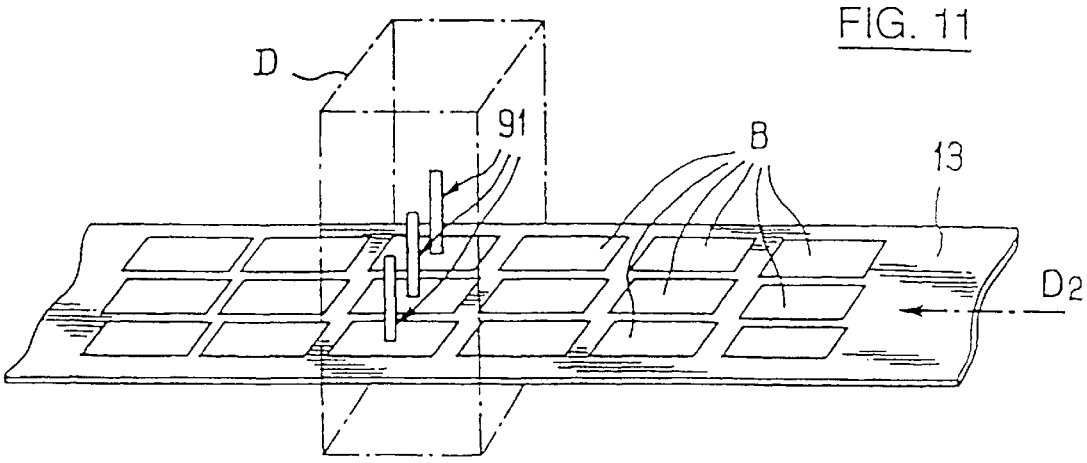

The installation shown in FIG. 11 includes a moving conveyor belt 13 which advances stepwise, as represented by arrow $D_2$.

The belt 13 conveys thermoformed trays B designed to receive a substance, e.g. a food product, which is delivered by metering or manual filling tools 91.

Each tool 91 is assigned to a tray, the trays being conveyed in adjacent rows by the belt 13.

The close protection apparatus D is installed at the tools 91.

Figure 12:
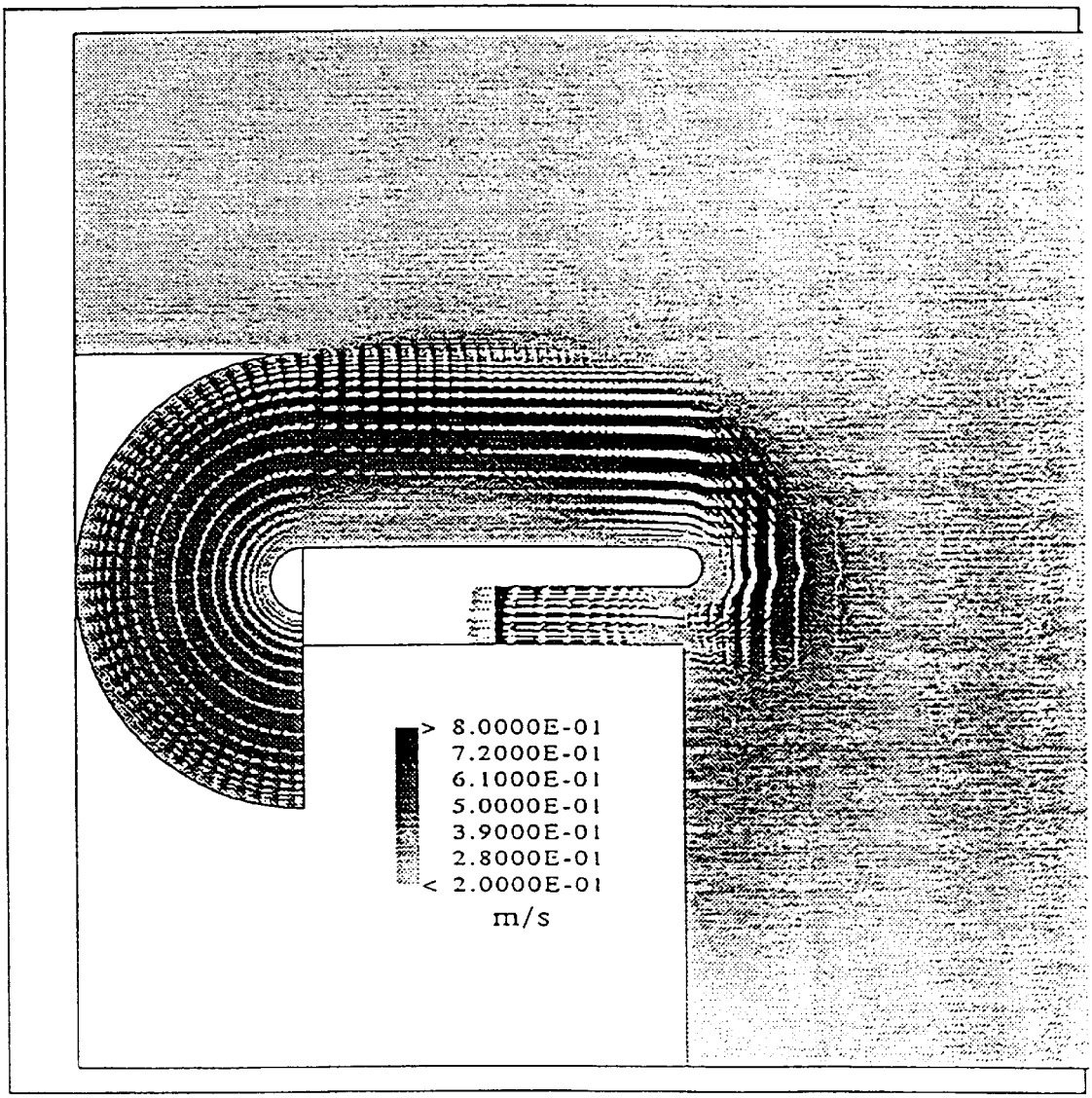
FIGS. 12, 13, and 14 are illustrations showing the configurations of the air flows in three apparatuses having different geometrical shapes, the illustrations resulting from simulations performed by computer, the speeds being represented using a scale of shades of grey going from light to dark in the direction of increasing speed.
Figure 13:
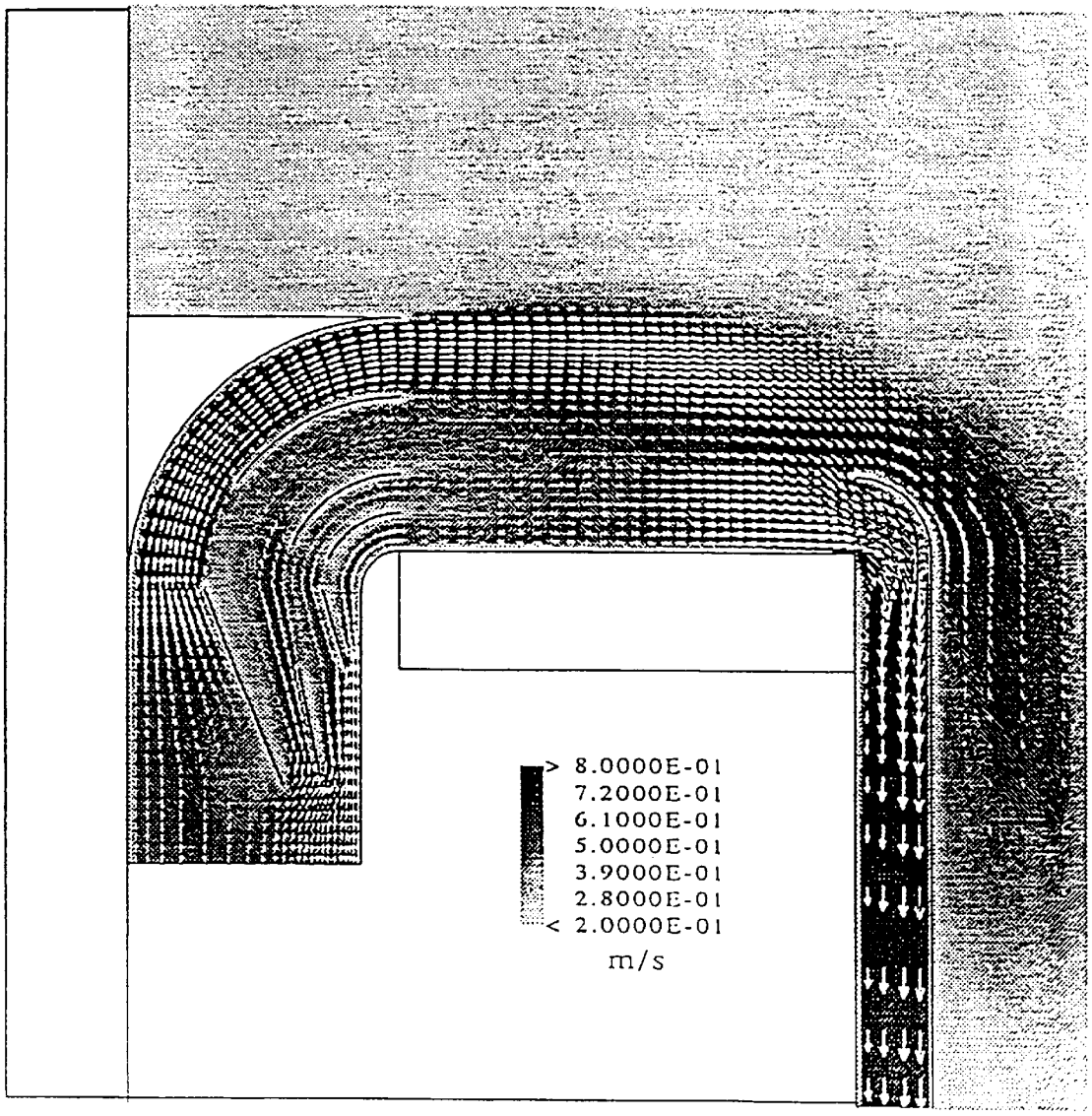
Figure 14:
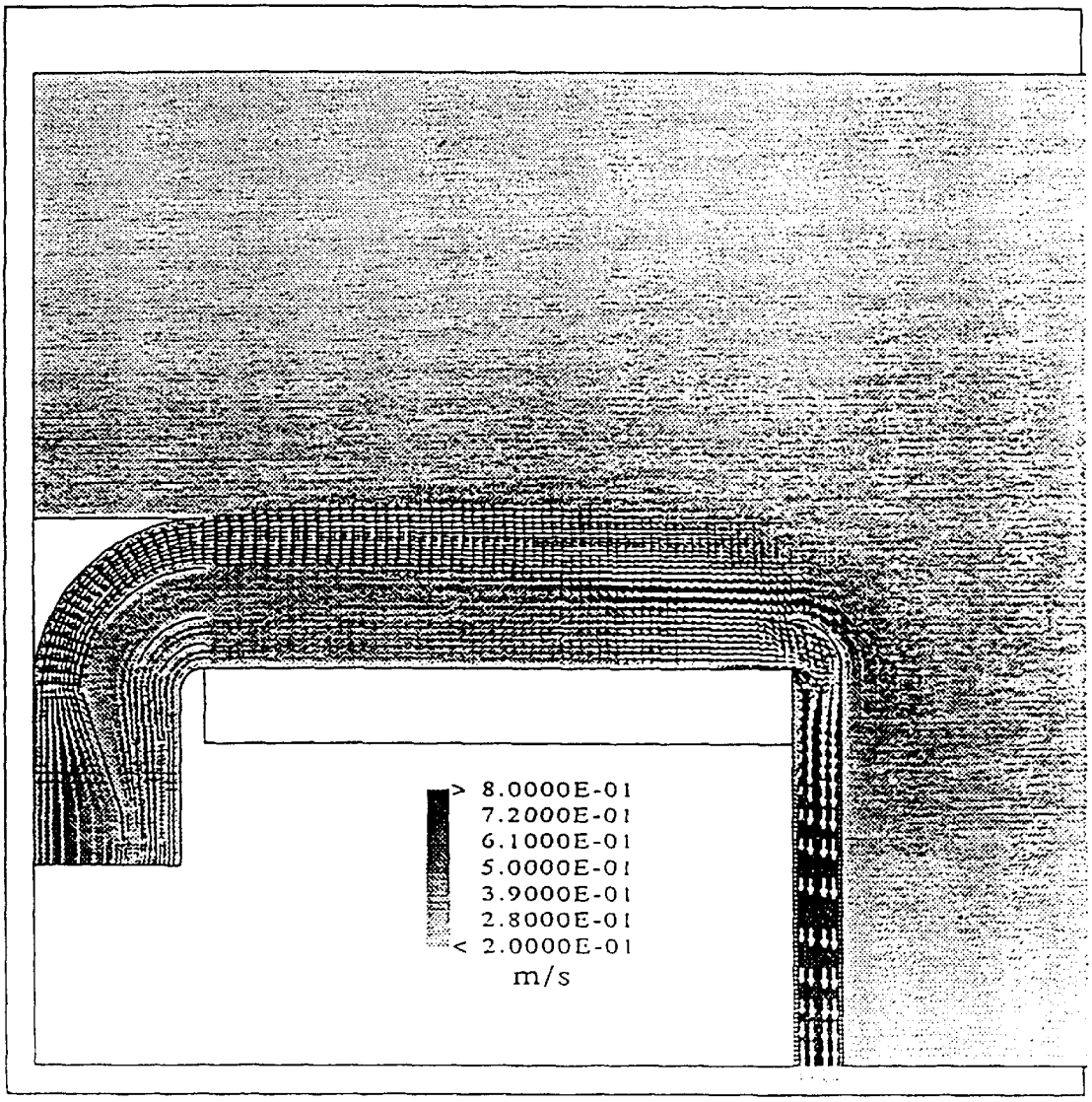

The illustrations shown in FIGS. 12 to 14 relate to modelled flows calculated by computer.

The air enters the guide with a uniform speed distribution, the value of the speed being E.

At certain points of the flow, white arrows are shown whose length is proportional to the magnitude of the speed.

In addition to being represented by the arrows, the distribution of the speeds is represented by shades of grey going from light to dark in the direction of increasing speed. The value of the speed is given by the scale shown in the drawing.

The diagram in FIG. 12 corresponds to a configuration analogous to the configuration of the first embodiment, using a semi-cylindrical guide.

The height of the flow at the outlet of the guide is 0.30 m, the width of the work surface 1 is 0.60 m; the thickness of the work surface is 6 cm; and the height of the suction inlet is 9 cm.

The drawing shows the existence of an almost static space (light grey) above the work surface, and shows the high-speed high stream (very dark grey) which forms a shield overlying the work surface and going round the free edge to the suction intake.

The illustrations in FIGS. 13 and 14 relate to apparatus similar to the second embodiment (FIG. 3).

These two views show the top stream and the bottom stream, respectively dark grey (high speed), and light grey (low speed).

The drawings in FIGS. 13 and 14 are to different scales, the height of the flow produced by the guide, upstream from the work surface being the same in both cases, i.e. equal to 0.30 m.

In the modelling shown in FIG. 3, the width of the work surface is 0.60 m, whereas its width in FIG. 14 is 1.20 m.

The apparatus of the invention is not necessarily associated with processing of items supported or conveyed by a work surface.

The invention may also be implemented to equip an installation merely for transferring sensitive substances from one place to another, so that the substances transported are shielded from the surrounding environment which might be polluted.

When the items are processed, the range of possible applications is vast.

Thus, by way of example, mention may be made of applications to transferring bottles from a separating station to a filling station for filling them with a liquid that is sensitive to contamination.

Mention may be made of the following examples of applications using a stationary work surface for which a clean room would be an overdimensioned solution:

- dental surgeries, in which the apparatus could serve to maintain in a sterile state orthodontic instruments laid on a support;
- operating theaters, for protecting the field of operation of the patient;
- the catering trade, for protecting the table on which meals are prepared and packaged;
- laboratories in the following industries: food, microbiology, microelectronics, and opto-electronic and/or acousto-electronic component processing or assembly, in which laboratories substances must be protected from particulate contamination; and
- various domestic applications, e.g. for protecting a person against pollen or dust, or for protecting zones in which contact lenses are prepared.

What is claimed is:

1. A method for closely protecting a workstation comprising:

(a) providing a horizontal work surface comprising a top face, an upstream side and a free side opposite said upstream side, said free side having an edge, said work surface being unobstructed and accessible from above the top face and from at least said free side;

(b) continuously blowing clean air over the work surface from the upstream side toward the free side so as to form a substantially horizontal flow of the clean air across the work surface and so that the flow of air has a velocity gradient with an upper layer or stream of air having a substantially higher velocity of flow than a lower layer or stream of air flowing proximal to the top face; and (c) continuously sucking air from the flow of air into a suction intake disposed near the edge of the free side.

2. A method according to claim 1, comprising recycling the air sucked into said suction intake by filtering or purifying the sucked air and then blowing the filtered or purified air over the work surface from the upstream side.

3. A method according to claim 1, wherein the work surface is a stationary table top.

4. A method according to claim 1, wherein the work surface is a conveyor.

5. An apparatus for closely protecting a horizontal work surface, said work surface comprising a top face, an upstream side and a free side opposite said upstream side, said upstream and free sides having respective edges, said work surface being unobstructed and accessible from above the top face and from at least said free side, said apparatus comprising:

(a) air blowing means for blowing clean air continuously over the work surface from the upstream side to the free side so as to form a substantially horizontal flow of the clean air across the work surface and so that the flow of air has a velocity gradient with an upper layer or stream of the air having a substantially higher velocity of flow than a lower layer or stream of the air flowing proximal to the top face; and (b) a suction intake disposed near the edge of the free side for collecting air from the flow of air blown to the free side.

6. An apparatus according to claim 5, comprising channeling means for channeling air from the suction intake to the air blowing means to form a closed circuit path for recycling the flow of air, said air blowing means comprising a flow generator disposed in the path that sucks air through the suction intake and blows it out of the air blowing means and over the work surface.

7. An apparatus according to claim 6, comprising air purification means for filtering or purifying the recycled air, said air purification means being disposed in the path downstream of said flow generator.

8. An apparatus according to claim 5, wherein the air blowing means comprises a flow generator that blows the clean air, said flow generator being disposed below the work surface, said air blowing means further comprising tubular guide means, including a tubular guide for deflecting air blown by the flow generator 180° C. at the upstream side, said tubular guide having a shape that is substantially semi-cylindrical.

9. An apparatus according not claim 8, comprising at least one deflector disposed within said tubular guide.

10. An apparatus according to claim 5, wherein the air blowing means comprises a duct, a tubular guide and an air flow generator, said duct being disposed adjacent the upstream side and being substantially vertical, the duct having a low end in fluid communication with the air flow generator and a high end that is substantially level with the top face of the work surface and that is connected to the tubular guide, said tubular guide having a shape that is substantially that of a quarter cylinder such that the tubular guide deflects air flow from the generator and through the tubular duct in a generally horizontal direction.

11. An apparatus according to claim 10, comprising deflector means for increasing the velocity of flow of the air in the upper layer relative to the velocity of flow of the air in the lower layer, said deflector means comprising at least one deflector disposed within the duct at an acute angle relative to a substantially vertical wall of the duct.

12. An apparatus according to claim 11, wherein the deflector means comprise a plurality of deflectors including said at least one deflector, said plurality of deflectors comprising a plurality of plates disposed in a fan configuration wherein respective bottoms of said plurality of plates are closer together than respective tops of said plurality of plates.

13. An apparatus according to claim 12, wherein an innermost of said plurality of plates that is closest to said work surface is substantially vertical.

14. An apparatus according to claim 5, wherein the air blowing means comprises visor means for directing the upper layer or stream in a slightly downward direction, said visor means comprising a portion that hangs over the work surface.

15. An apparatus according to claim 5, wherein said suction intake comprises top intake means for collecting the air in the upper stream and for allowing it to pass through the suction intake substantially without headloss and bottom intake means for braking the flow of air in the lower stream.

16. An apparatus according to claim 5, wherein the work surface is a stationary table top.

17. An apparatus as claimed in claim 5, wherein the work surface is a conveyor.

* * * * *

UNITED STATES PATENT AND TRADEMARK OFFICE

CERTIFICATE OF CORRECTION

PATENT NO. : 6,095,918
DATED : August 1, 2000
INVENTOR(S) : Georges Arroyo et al.

It is certified that error appears in the above-identified patent and that said Letters Patent is hereby corrected as shown below:

Title page,
Item [73], Assignee, "N.I.R." should read -- U.N.I.R. --.

Signed and Sealed this

Twenty-fourth Day of December, 2002

JAMES E. ROGAN
*Director of the United States Patent and Trademark Office*